US008611790B2

(12) United States Patent
Souda

(10) Patent No.: US 8,611,790 B2
(45) Date of Patent: Dec. 17, 2013

(54) IMAGE FORMING APPARATUS

(75) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 37 days.

(21) Appl. No.: 13/406,960

(22) Filed: Feb. 28, 2012

(65) Prior Publication Data

US 2012/0219316 A1 Aug. 30, 2012

(30) Foreign Application Priority Data

Feb. 28, 2011 (JP) ..... 2011-042705

(51) Int. Cl.
*G03G 15/00* (2006.01)

(52) U.S. Cl.
USPC ..... 399/121; 399/107; 399/110; 399/111; 399/297; 399/308; 198/860.1; 198/860.2

(58) Field of Classification Search
USPC ..... 399/107, 110, 111, 121, 297, 302, 308; 198/860.1, 860.2
See application file for complete search history.

(56) References Cited

U.S. PATENT DOCUMENTS

| | | | | |
|---|---|---|---|---|
| 2007/0147891 | A1 * | 6/2007 | Mori | 399/121 |
| 2010/0247174 | A1 * | 9/2010 | Hori et al. | 399/303 |
| 2010/0247198 | A1 | 9/2010 | Saiki et al. | |
| 2011/0064464 | A1 * | 3/2011 | Ju et al. | 399/121 |

FOREIGN PATENT DOCUMENTS

| | | | | |
|---|---|---|---|---|
| JP | 2002148879 | A * | 5/2002 | G03G 15/00 |
| JP | 2005242124 | A | 9/2005 | |
| JP | 2006-251524 | A | 9/2006 | |
| JP | 2009237317 | A | 10/2009 | |
| JP | 2010231087 | A | 10/2010 | |

OTHER PUBLICATIONS

Notice of Reasons for Rejection issued in corresponding Japanese Patent Application No. 2011-042705 dated Mar. 19, 2013.

* cited by examiner

*Primary Examiner* — David Gray
*Assistant Examiner* — Francis Gray
(74) *Attorney, Agent, or Firm* — Banner & Witcoff, Ltd.

(57) ABSTRACT

An image forming apparatus is provided which includes an image forming unit, a main body having a pair of frames, a pair of rollers, a belt which is endless, and a reinforcing member. The frames are disposed to sandwich the image forming unit therebetween. The rollers are spaced apart from each other such that an axial direction of each of the rollers extends in a direction perpendicular to the frames. The belt extends around the rollers. The reinforcing member is disposed in an area enclosed by the belt. One end of the reinforcing member is fixed to one of the frames, and the other end of the reinforcing member is fixed to the other one of the frames.

10 Claims, 7 Drawing Sheets

IMAGE FORMING APPARATUS

CROSS REFERENCE TO RELATED APPLICATION

This application claims priority from Japanese Patent Application No. 2011-042705, filed on Feb. 28, 2011, the content of which is incorporated herein by reference in its entirety.

TECHNICAL FIELD

Aspects of the disclosure relate to an image forming apparatus.

BACKGROUND

A known image forming apparatus may include a pair of frames partially constituting a main body for accommodating an image forming unit. The frames are disposed to sandwich the image forming unit therebetween. A plurality of reinforcing members, e.g., beams, are disposed between the pair of frames.

The image forming apparatus needs a space for disposing the beams, and thus it is difficult to further reduce the physical size of the image forming apparatus. If the beams are eliminated, the rigidity of the main body may deteriorate, leading to deformation of the frames and the image forming unit and deterioration in quality of an image to be formed.

SUMMARY

Aspects of the disclosure may provide an image forming apparatus whose size is reduced without deterioration in rigidity of a main body.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings.

A general structure of an image forming apparatus 1 will be described.

Figure 1:
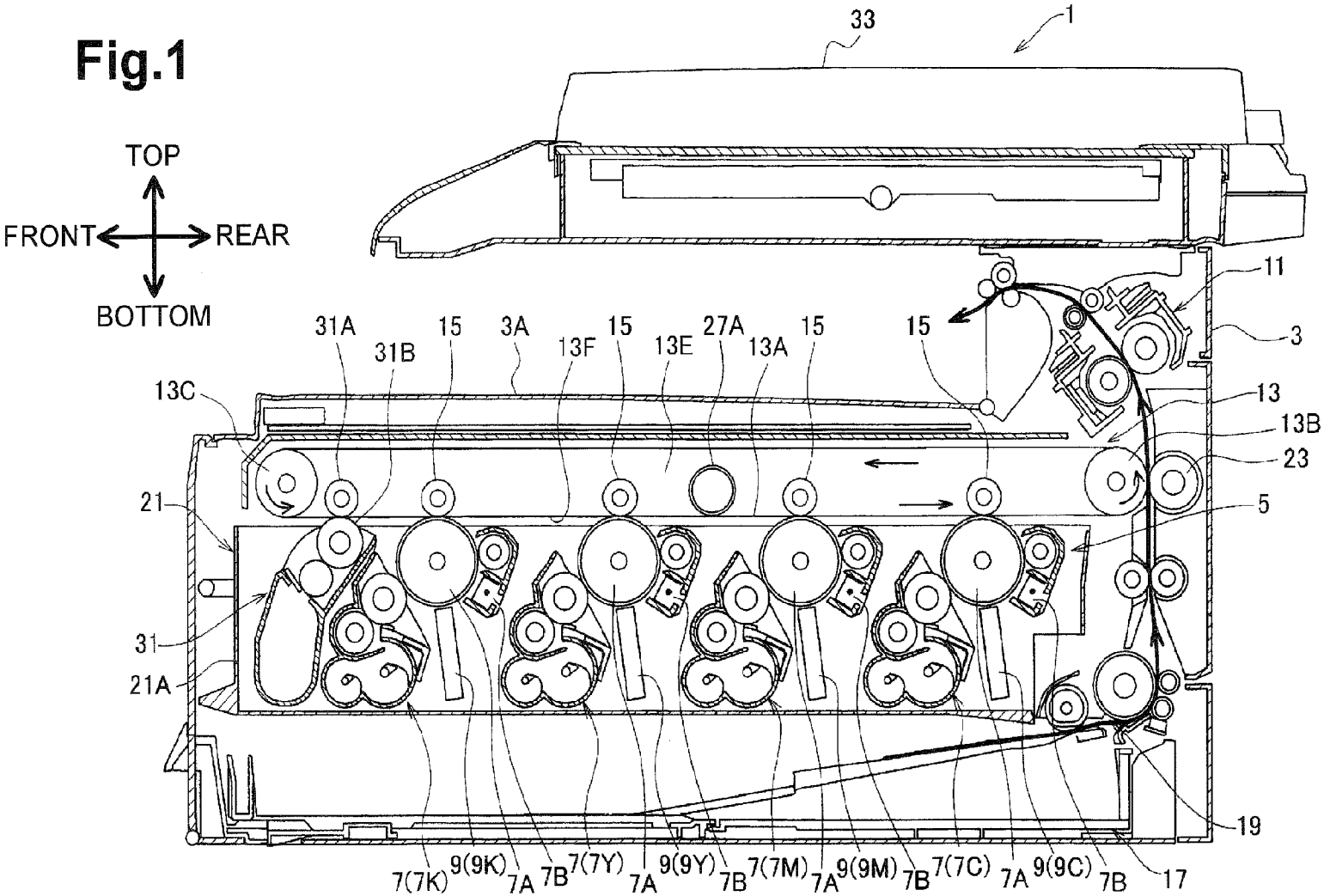
FIG. 1 is a sectional view schematically illustrating an image forming apparatus according to a first embodiment.

In the following description, directions are referred when the image forming apparatus 1 is viewed from a user in front of the image forming apparatus 1. In FIG. 1, the right side of the drawing is referred to as the front or front side of the image forming apparatus 1, and the left side of the drawing is referred to as the rear or rear side of the image forming apparatus 1. When the image forming apparatus 1 is viewed from the front side, the left side is referred to as the left or left side, and the right side is referred to as the right or right side. The directions, front, rear, left, right, top, and bottom, shown in each drawing are referenced based on the directions shown in FIG. 1.

As shown in FIG. 1, the image forming apparatus 1 may include, in a housing 3, an image forming unit 5 that is configured to form an image on a recording sheet such as plain paper and a transparency sheet (herein after referred to as "sheet") by transferring a developer image on the sheet. The image forming unit 5 includes process units 7, exposure units 9, and a fixing unit 11, as is known.

In the disclosure, for example, four process units 7K, 7Y, 7M, and 7C are arranged in line along a moving direction of a transfer belt 13A, and four exposure units 9K, 9Y, 9M, and 9C are provided in association with the process units 7K, 7Y, 7M, and 7C.

Figure 2:
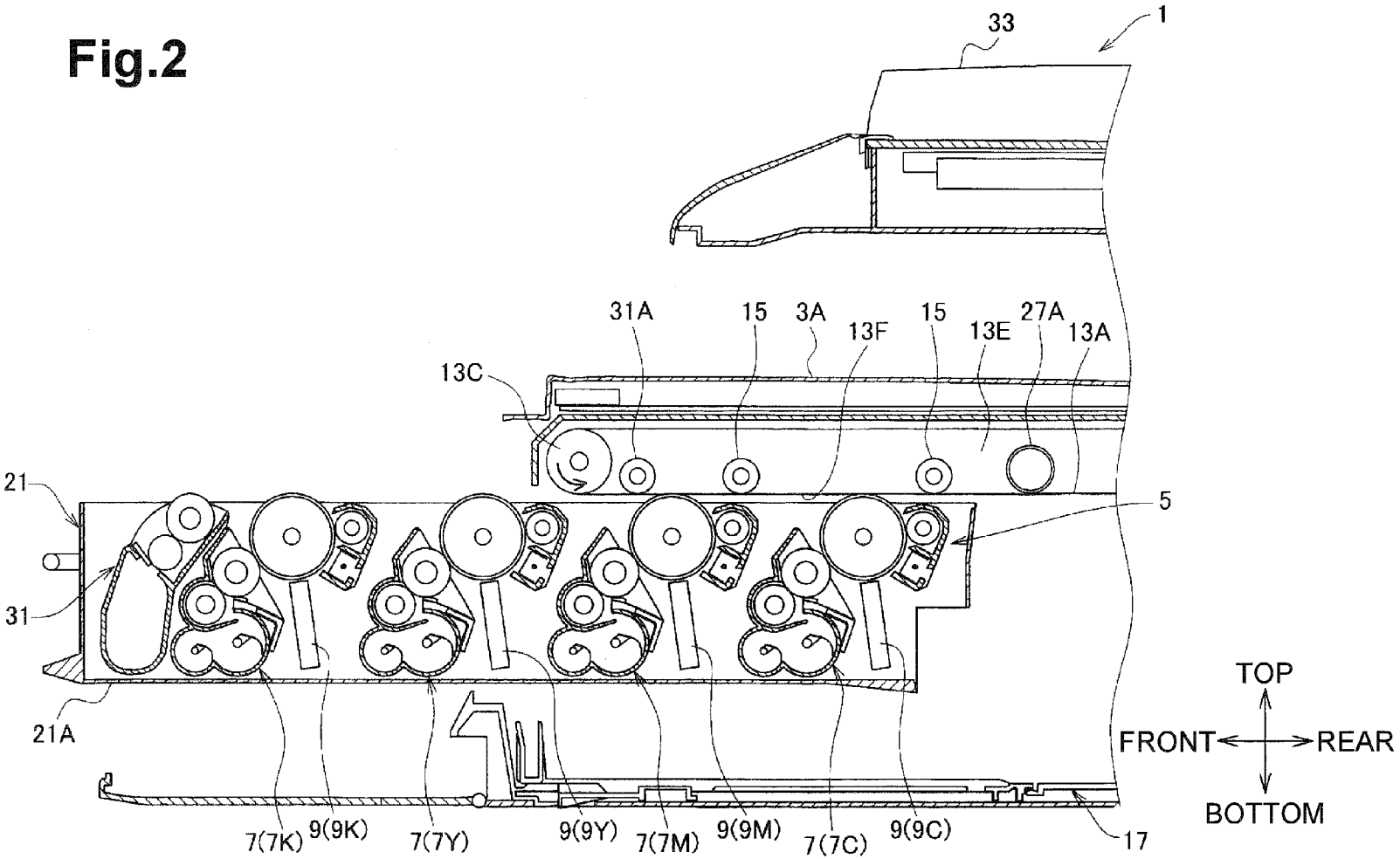
FIG. 2 is a sectional view schematically illustrating the image forming apparatus according to the first embodiment.

The process units 7K, 7Y, 7M, and 7C and the exposure units 9K, 9Y, 9M, and 9C are detachably attached to a drawer casing 21A, and constitute a drawer unit 21. The drawer unit 21 is configured to move between an inside position where the drawer unit 21 is in a main body of the image forming apparatus 1 and an outside position where the drawer unit is outside the main body of the image forming apparatus 1 in a direction parallel to a belt extending direction where the transfer belt 13A extends (e.g., in a front-rear direction, in this embodiment). Thus, four process units 7K, 7Y, 7M, and 7C can be moved together relative to the main body (see FIG. 2).

The transfer belt 13A is endless, extends around a drive roller 13B and the driven roller 13C, and is configured to rotate around the drive roller 13B and the driven roller 13C along with rotation of the rollers 13B and 13C in the belt extending direction. The transfer belt 13A, the drive roller 13B, the driven roller 13C, and a pair of belt side frames 13D (see FIG. 3) that supports the rollers 13B and 13C constitute a belt unit 13.

Each of the process units 7K, 7Y, 7M, and 7C may include a photosensitive drum 7A configured to carry a developer image thereon and a charger 7B configured to charge the photosensitive drum 7A. The photosensitive drum 7A is charged by the charger 7B and then exposed by the exposure unit 9 such that an electrostatic latent image is formed on an outer peripheral surface of the photosensitive drum 7A. When charged developer is supplied to the photosensitive drum 7A, a developer image is formed or carried on the outer peripheral surface of the photosensitive drum 7A.

Primary transfer rollers 15 are disposed at positions facing the corresponding photosensitive drums 7A via the transfer belt 13A. The primary transfer rollers 15 are configured to transfer developer images carried on the photosensitive drums 7A on a stretched surface 13F of the transfer belt 13A. The developer images carried on the surfaces of the photosensitive drums 7A are sequentially transferred and overlaid one on top of the other on the transfer belt 13A.

The stretched surface 13F of the transfer belt 13A is a flat surface portion of the transfer belt 13A between the drive roller 13B and the driven roller 13C facing the photosensitive drums 7A of the process units 7.

A sheet supply tray 17 is disposed below the belt unit 13 and is configured to store a stack of sheets, which are to be singly fed to the transfer belt 13A (to the drive roller 13B in this embodiment) by a feeder mechanism 19.

A secondary transfer roller 23 is disposed at a position opposing the drive roller 13B via the transfer roller 13A and is configured to transfer the developer images transferred onto the transfer belt 13A to a sheet supplied from the sheet supply tray 17. The sheet having the developer images thereon is fed to the fixing unit 11 where the transferred developer images are melted or fixed onto the sheet by heat. Then, the sheet is ejected to an output tray 3A disposed above the image forming unit 5.

A belt cleaner 31 is configured to remove remaining developer from the transfer belt 13A. The belt cleaner 31 includes a backup roller 31A and a cleaning roller 31B. The backup roller 31A is configured to press the transfer belt 13A to the cleaning roller 31B while applying a voltage to remove the remaining developer.

An image reading apparatus 33 is disposed above the output tray 3A. The image reading apparatus 33 is of a flat bed type and is configured to read an image on a document.

A framework of the main body of the image forming apparatus 1 will be described.

Figure 3:
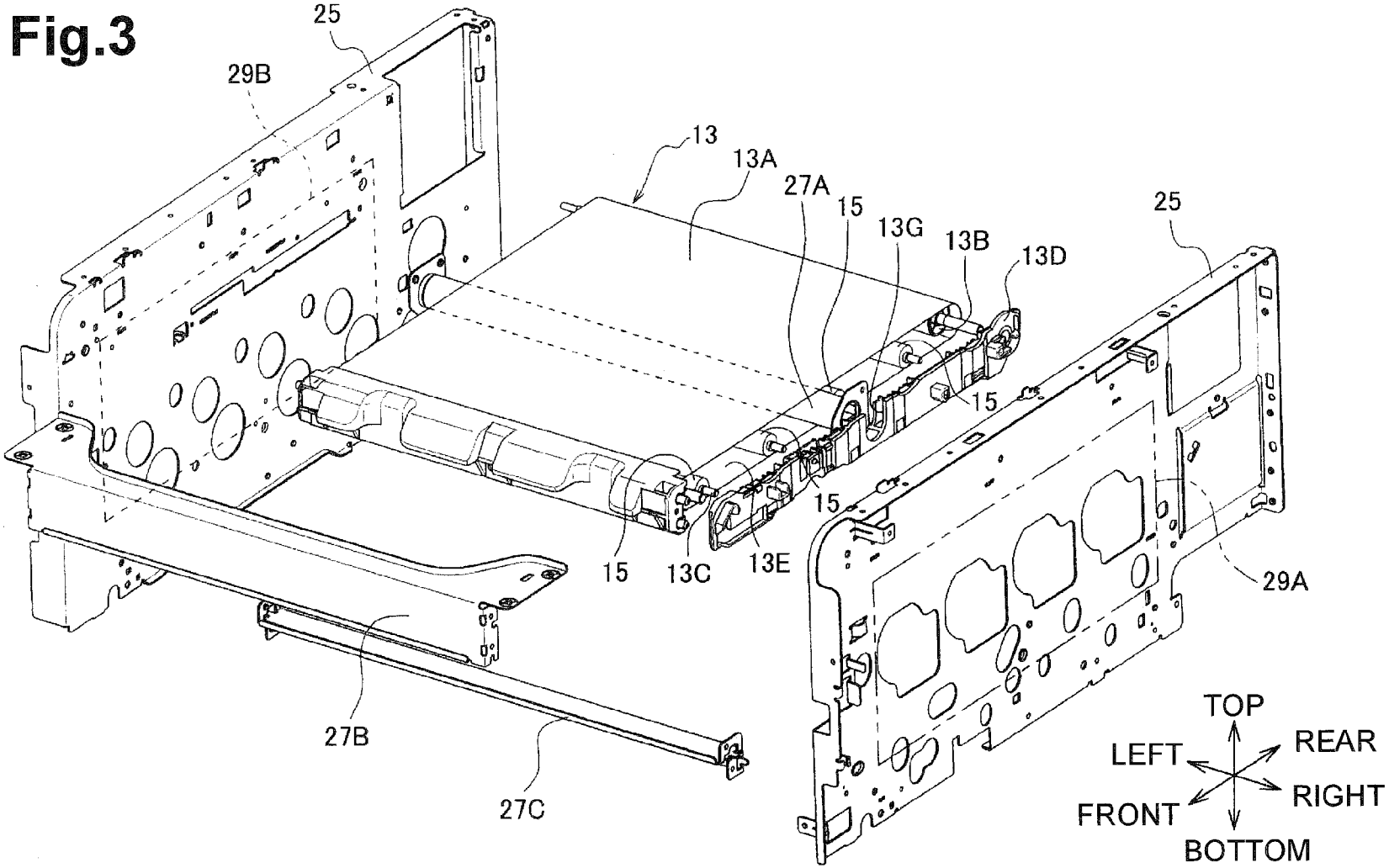
FIG. 3 is an exploded perspective view illustrating main frames and beams of the image forming apparatus according to the first embodiment.

As shown in FIG. 3, a pair of main frames 25 are shaped in the form of plates and disposed on both sides of the image forming unit 5 (the drawer unit 21) and the belt unit 13 in their width direction to sandwich them. The main frames 25 and the housing 3 mainly constitute the main body of the image forming apparatus 1. The width direction is a direction perpendicular to the sheet feeding direction and thickness direction, and in this embodiment, matches a left-right direction of the image forming apparatus 1.

The main frames 25 are formed by press-working a metal sheet, e.g., a cold rolled sheet.

The sheet supply tray 21 may be non-destructively attachable to and removable from the front of the main body 10. The sheet supply mechanism 22 is configured to separate a sheet P from the sheet supply tray 21 and feed the sheet P to a position between the image forming unit 40 and the belt unit 50. A first electrical circuit board 29A is shaped in the form of plate, disposed outside the right main frame 25, and is configured to supply electricity to the image forming unit 5. A second electrical circuit board 29B is disposed outside the left main frame 25 and configured to supply electricity to an electrical motor (not shown) that supplies a drive force to each roller.

The main frames 25 are connected by reinforcing members, e.g. beams, 27A, 27B and 27C, e.g., beams, made of a metal, extending therebetween. Both ends of each of the beams 27A, 27B and 27C may be fixed to the main frames 25 by a mechanical fastening member, e.g. a screw or by welding.

In this embodiment, the beams 27A, 27B and 27C are fixed to the main frames 25 by screws (not shown). Thus, both ends of the beams 27A, 27B and 27C are provided with flanges functioning as surfaces to abut the main frames 25.

The drive roller 13B and the driven roller 13C of the belt unit 13 are disposed such that their axial direction is parallel to a direction perpendicular to the main frames 25 (the width direction), like the beams 27A-27C. Thus, an area 13E enclosed by the transfer belt 13A (except for the drive roller 13B and the driven roller 13C) is a space passing through from the right main frame 25 to the left main frame 25.

As shown in FIG. 1, in this embodiment, the beam 27A having a tubular shape is disposed between adjacent primary transfer rollers 15 in the area 13E enclosed by the transfer belt 13A. The beam 27A is tubular (cylindrical in this embodiment) and has, inside, an opening or a communication passage passing through in a longitudinal direction thereof Harnesses (not shown) for electrically connecting the first and second electrical circuit boards 29A and 29B are disposed in the communication passage.

The beam 27A passes through the area 13E enclosed by the transfer belt 13A, and both ends of the beam 27A are fixed to the main frames 25. Belt side frames 13D are located one on each end of the belt unit 13 in the width direction so as to close the area 13E. Each of the belt side frames 13D is formed with an opening 13G through which the beam 27A passes.

The primary transfer rollers 15 and the secondary transfer roller 23 are subjected to high voltage so as to transfer developer images. Thus, the transfer belt 13A, the drive roller 13B and the driven roller 13C may bear unnecessary electrical charges. As the unnecessary electrical charges may lead to improper transferring, the drive roller 13B and the driven roller 13C are electrically grounded to eliminate such unnecessary electrical charges.

Figure 4:
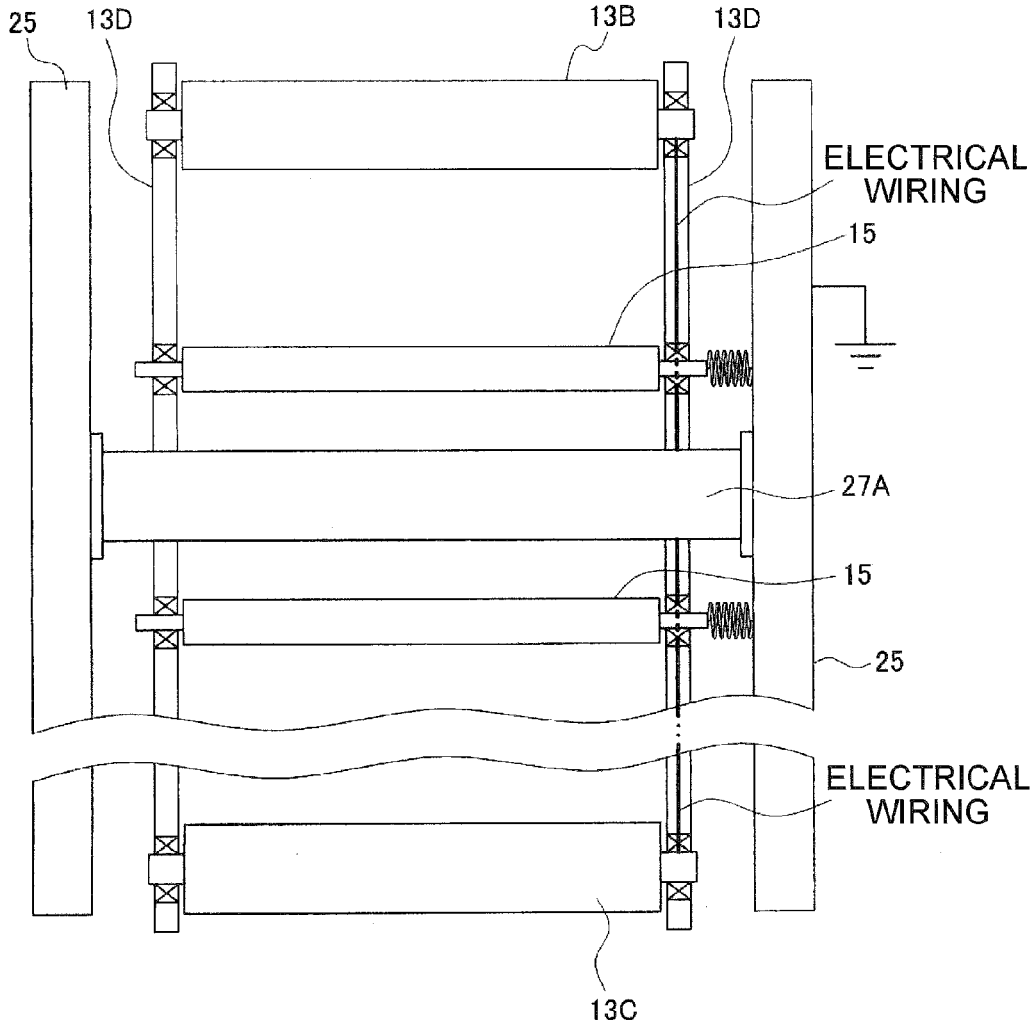
FIG. 4 schematically illustrates a ground circuit in the image forming apparatus according to the first embodiment.

As shown in FIG. 4, in this embodiment, the drive roller 13B and the driven roller 13C are electrically connected to the beam 27A, and the main frames 25 are grounded, thereby the drive roller 13B and the driven roller 13C are electrically grounded via the beam 27A and the main frames 25.

Specifically, bearings that support the drive roller 13B and the driven roller 13C rotatably are electrically connected to the beam 27A and the main frames 25 are electrically grounded.

The left and right main frames 25 are connected by the beams 27A to 27C and covered by the housing 3. In usual service conditions, it is impossible for the user to disassemble the main body by removing the beams 27A to 27C from the main frames 25.

In addition, the beam 27A passes through the belt unit 13 in the width direction. In usual service conditions, it is impossible for the user to remove the belt unit from the main frames 25. In other words, to remove the belt unit from the main body, the image forming apparatus 1 itself needs disassembling.

In this embodiment, the beam 27A is disposed in the area 13E enclosed by the transfer belt 13A, and thus there is no need to provide for an area intended to dispose the beam 27A. Thus, the need for increasing the physical size of the image forming apparatus 1 can be minimized without the rigidity of the main body being lowered.

In this embodiment, the beam 27A is disposed in a space between the adjacent primary transfer rollers 15. Thus, compared with a case where the beam 27 is disposed such that the beam 27A and one primary transfer roller 15 overlap each other in a direction perpendicular to the belt extending direction, this embodiment obviates the need to increase the physical size of the image forming apparatus 1 in the direction perpendicular to the belt extending direction.

In this embodiment, the drive roller 13B and the driven roller 13C are electrically connected to a ground side via the beam 27A and the main frames 25. Thus, an electrical circuit to eliminate electricity from the transfer belt 13A, the drive roller 13B and the driven roller 13C can be easily structured.

Figure 5:
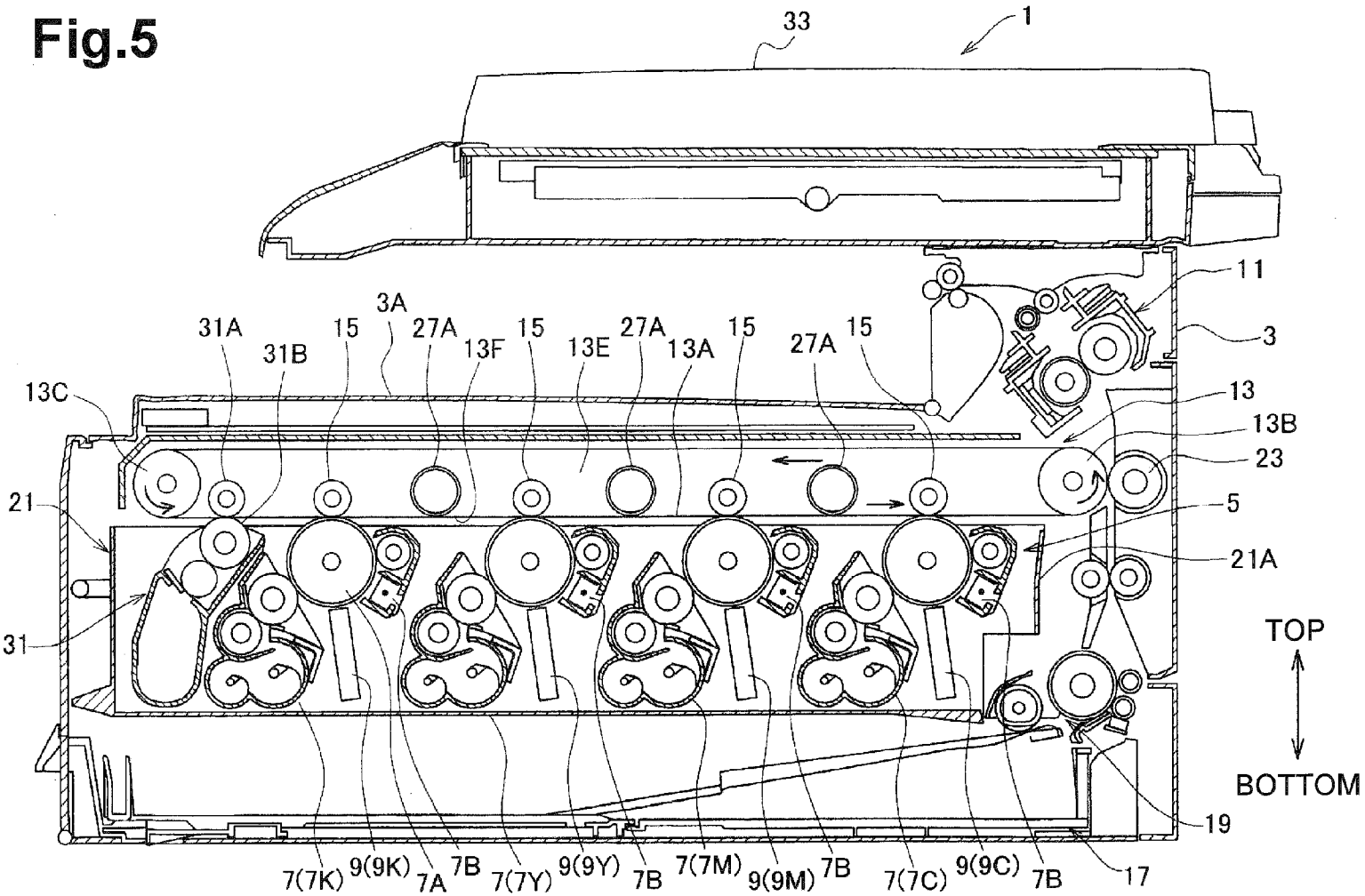
FIG. 5 is a sectional view schematically illustrating an image forming apparatus according to a second embodiment.

A second embodiment of the disclosure will be described with reference to FIG. 5.

The first embodiment shows one beam 27A disposed in the area 13E enclosed by the transfer belt 13A. In the second embodiment, plural beams 27A are provided along the belt extending direction such that the beams 27A are spaced alternately with the primary transfer rollers 15.

Thus, in the second embodiment, the need for increasing the physical size of the image forming apparatus 1 can be minimized and the rigidity of the main body can be increased.

Figure 6:
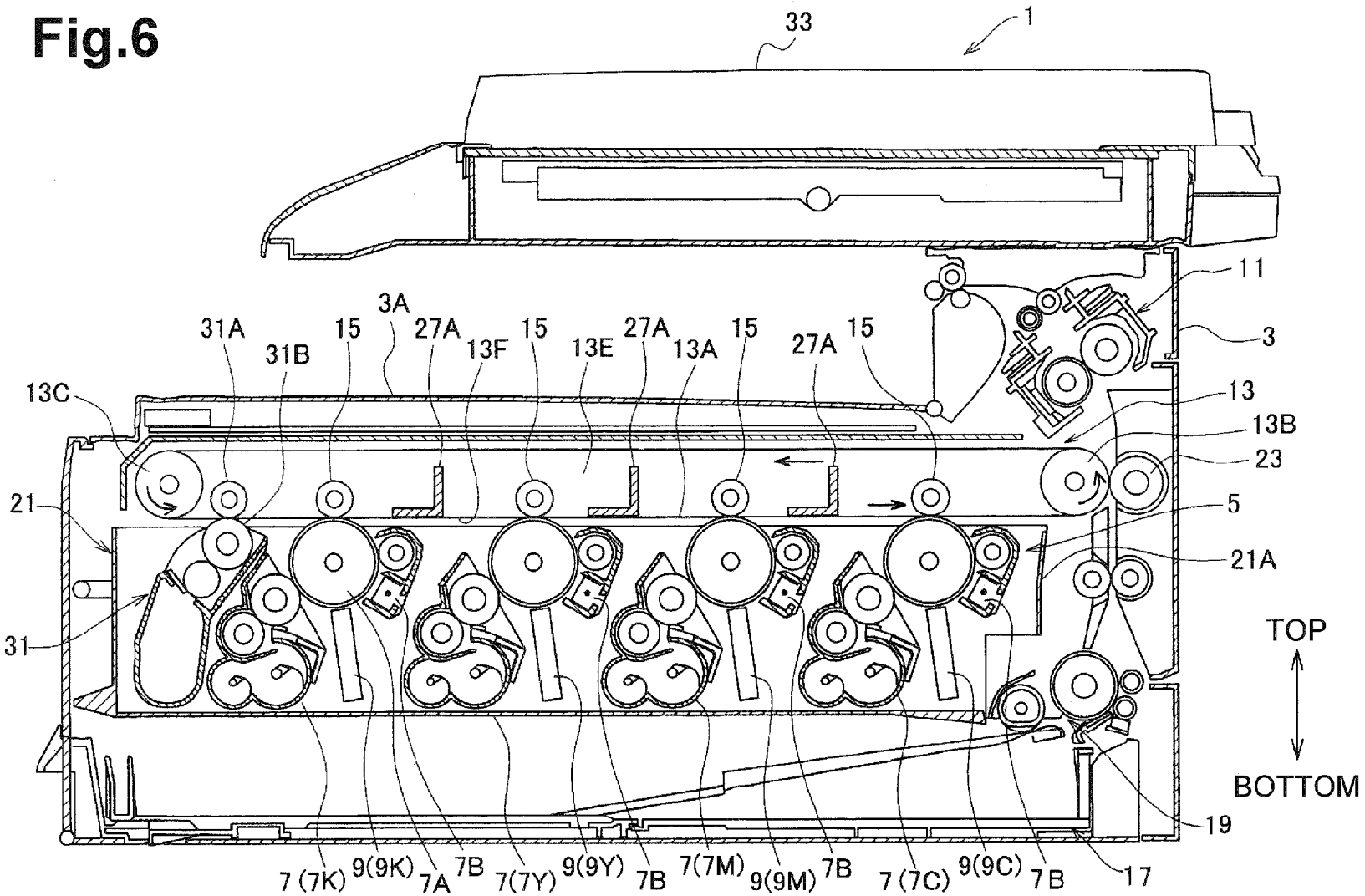
FIG. 6 is a sectional view schematically illustrating an image forming apparatus according to a third embodiment.
Figure 7:
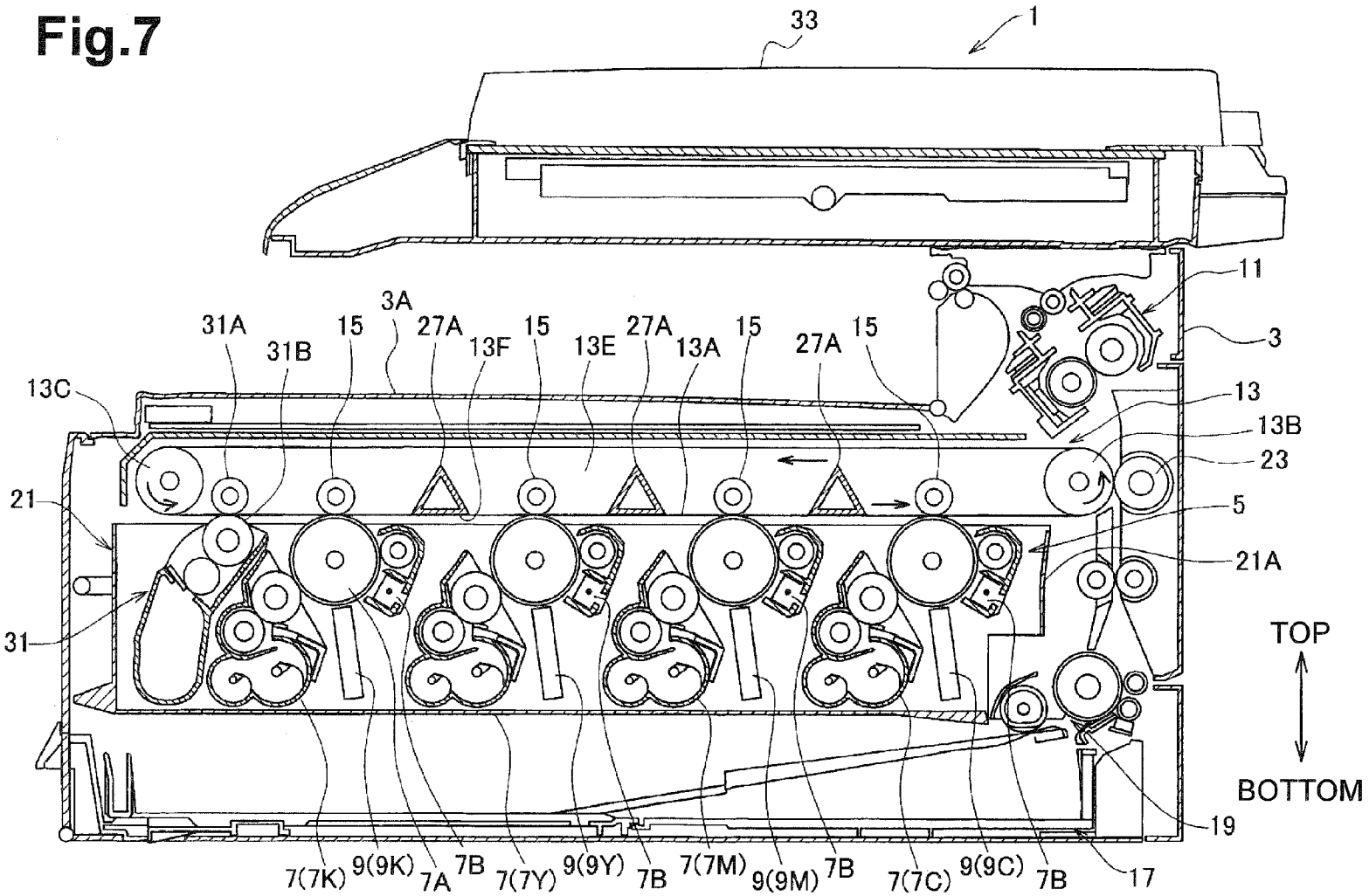
FIG. 7 is a sectional view schematically illustrating an image forming apparatus according to a fourth embodiment.

A third embodiment of the disclosure will be described with reference to FIGS. 6 and 7.

Third embodiment shows the beams 27A which are not cylindrical or tubular shape. For example, FIG. 6 shows the beams 27A having an L-shape in cross section and FIG. 7 shows the beams 27A having a triangle shape in cross section as shown in FIG. 7.

The above illustrative embodiments show, but are not limited to, an intermediate transfer type image forming apparatus 1 in which developer images are transferred and overlaid one on top of the other on the transfer belt 13A and then transferred to a sheet. The disclosure may apply to a direct type image forming apparatus in which developer images are directly transferred onto a sheet fed by the transfer belt 13A.

The above illustrative embodiments show, but are not limited to, the exposure unit 9 in which plural LEDs are arranged in an axial direction of the photosensitive drum 7A. The disclosure may apply to a scanner type exposure unit that scans light in the axial direction of the photosensitive drum.

The above illustrative embodiments show, but are not limited to, the main frames 25 made of metal. The main frames may be made of resin.

The above illustrative embodiments show, but are not limited to, the process units 7 accommodated in the drawer casing 21A as a unit.

The above illustrative embodiments show, but are not limited to, the cylindrical beam 27A disposed in the area 13E. The beam 27A may be formed by bending a plate, like the beams 27B and 27C.

The above illustrative embodiments show, but are not limited to, the transfer members that are rollers.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. An image forming apparatus comprising:

an image forming unit configured to form an image on a recording medium;

a main body having a pair of frames, the frames being disposed to sandwich the image forming unit therebetween;

a pair of rollers spaced apart from each other such that an axial direction of each of the rollers extends in a direction perpendicular to the frames;

a belt which is endless, the belt extending around the rollers; and a reinforcing member disposed in an area enclosed by the belt, the reinforcing member extending in a direction parallel to the axial direction, one end of the reinforcing member being fixed to one of the frames, the other end of the reinforcing member being fixed to the other one of the frames.

2. The image forming apparatus according to claim 1, wherein the image forming unit includes a plurality of photosensitive members each configured to carry a developer image thereon, and the photosensitive members are disposed to face a stretched surface of the belt and arranged in a line along a belt extending direction where the belt extends around the rollers, wherein a plurality of transfer members are disposed at positions facing the photosensitive members such that the transfer members and the photosensitive members sandwich the belt and are configured to transfer developer images carried by the photosensitive members, and wherein the reinforcing member is disposed between at least one adjacent pair of the transfer rollers.

3. The image forming apparatus according to claim 2, further comprising at least another reinforcing member, wherein the reinforcing member and the at least another reinforcing member are arranged in the belt extending direction.

4. The image forming apparatus according to claim 1, wherein the reinforcing member is cylindrical.

5. The image forming apparatus according to claim 1, further comprising a drawer unit configured to receive the image formation unit detachably therein, the drawer unit being configured to move between an inside position where the drawer unit is in the main body and an outside position where the drawer unit is outside the main body in a belt extending direction where the belt extends around the rollers, wherein the belt and the rollers are located in fixed positions in the main body when the drawer unit is in the outside position.

6. The image forming apparatus according to claim 1, wherein the rollers are electrically connected with the reinforcing member, and wherein the frames are made of metal and grounded.

7. The image forming apparatus according to claim 2, wherein the belt includes an intermediate transfer belt on which the developer images carried on the photosensitive members are transferred.

8. The image forming apparatus according to claim 1, wherein the image forming unit is disposed under the belt.

9. The image forming apparatus according to claim 1, wherein the reinforcing member is made of metal.

10. The image forming apparatus according to claim 1, wherein the reinforcing member includes a beam.

* * * * *